US007987780B2

(12) United States Patent
Teluob et al.

(10) Patent No.: US 7,987,780 B2
(45) Date of Patent: Aug. 2, 2011

(54) CANCELLATION APPARATUS

(75) Inventors: Jean-Marc Teluob, Cornas (FR); Alain Danjaume, Besayes (FR); Stephane Marisy, Bourg les Valence (FR); Karim Kara, Chabeuil (FR)

(73) Assignee: Solystic, Gentilly Cedex (FR)

( * ) Notice: Subject to any disclaimer, the term of this patent is extended or adjusted under 35 U.S.C. 154(b) by 622 days.

(21) Appl. No.: 12/159,546

(22) PCT Filed: Apr. 4, 2008

(86) PCT No.: PCT/FR2008/050604

§ 371 (c)(1),
(2), (4) Date: Jun. 27, 2008

(87) PCT Pub. No.: WO2008/139098

PCT Pub. Date: Nov. 20, 2008

(65) Prior Publication Data

US 2010/0231626 A1 Sep. 16, 2010

(30) Foreign Application Priority Data

Apr. 13, 2007 (FR) ..... 07 54468

(51) Int. Cl.
*B41L 47/46* (2006.01)

(52) U.S. Cl. ..... 101/91; 101/232; 101/235; 400/103

(58) Field of Classification Search ..... 400/103; 101/91

See application file for complete search history.

(56) References Cited

U.S. PATENT DOCUMENTS 5,440,979 A * 8/1995 Bonham et al. ..... 101/91
6,085,182 A * 7/2000 Cordery ..... 705/408
2004/0218958 A1 11/2004 Kruger et al.

FOREIGN PATENT DOCUMENTS

EP 0 038 176 A1 10/1981
EP 0 906 792 A2 4/1999

* cited by examiner

*Primary Examiner* — Matthew Luu
*Assistant Examiner* — Brian J Goldberg
(74) *Attorney, Agent, or Firm* — Rothwell, Figg, Ernst & Manbeck, P.C.

(57) ABSTRACT

Apparatus designed to cancel at least one postage or franking mark on a surface of a mailpiece moving on edge in a belt conveyor, said apparatus comprising: a conveyor portion with a plurality of small superposed belts and a plurality of superposed print heads; and control means for controlling the print heads in such a manner as to cause a print head to print one or more cancellation marks over the franking mark(s) detected on the mailpiece. Each print head is suitable for operating selectively with a plurality of superposed inkjets so as to print only a portion (¾, ½, ¼) of said cancellation mark or a scaled-down version thereof over the franking mark when said franking mark is positioned in such a manner as to be off-center between two belts.

8 Claims, 1 Drawing Sheet

CANCELLATION APPARATUS

CROSS-REFERENCE TO RELATED APPLICATIONS

This application is a 35 U.S.C. §371 National Phase Application from PCT/FR2008/050604, filed Apr. 4, 2008, and designating the United States, which claims the benefit of France Patent Application No. 0754468, filed Apr. 13, 2007.

BACKGROUND OF THE INVENTION

I. Field of the Invention

The invention relates to apparatus designed to cancel at least one postage or franking mark on a surface of a mailpiece that is moving on edge in a belt conveyor.

II. Discussion of the Background Art

Patent Document EP-906 792 discloses such apparatus for canceling/defacing postage or franking duty marks. In that apparatus, means are provided for determining the number of rows of franking duty marks to be canceled on the mailpiece in order to control the print heads.

Patent Document US2004/0218958 also discloses apparatus suitable for detecting the position of a postage or franking mark on a mailpiece that is moving, so as to control selective printing of a zone corresponding to the surface to be cancelled.

In general, postal authorities require the cancellation mark (which, inter alia, indicates the name of the postal authority, its logo, the number of the postal sorting center, and the date and time of the cancellation) to be printed, if possible, such that it is centered on the franking mark or on each franking mark when the same mailpiece bears more than one franking mark. A mailpiece being conveyed on edge at high speed in a belt conveyor can find itself in a position in which its bottom edge does not touch the slide bed of the conveyor (the mailpiece is "flying"). In which case, the top edge of the mailpiece can find itself in a free zone between two belts, and the franking mark on the surface of the mailpiece can thus find itself either partially hidden by a belt or partially visible in the vicinity of the top edge of the mailpiece. In such critical situations, a cancellation mark cannot be printed in such a manner as to be centered on the franking mark.

SUMMARY OF THE INVENTION

An object of the present invention is to provide a simple solution for canceling mailpieces of different sizes passing through a belt conveyor, including mailpieces that are in critical situations as indicated above.

To this end, the invention provides an apparatus comprising:

- a conveyor portion with a plurality of superposed belts that define a set of free zones in the form of non-touching superposed strips, the strips in each pair of strips being separated by a respective one of the belts;
- a print mechanism comprising a plurality of superposed print heads facing respective ones of said free zones;
- detector means positioned along the conveyor so as to detect at least one franking mark on the face of the mailpiece; and
- control means for controlling the print mechanism, on the basis of detecting said at least one franking mark on the surface of the mailpiece, in such a manner as to cause a print head to print a cancellation mark over the franking mark wherein each print head is suitable for operating selectively with a plurality of superposed inkjets, in that the detector means are also arranged to detect whether said franking mark is present in off-center manner in a free zone, and in that said control means are arranged so as to respond to detection of a franking mark that is off-center in said free zone by causing said print head disposed facing said free zone to operate while activating only some of its inkjets so as to print only a portion of said cancellation mark or a scaled-down version thereof over the off-center franking mark.

The basic idea of the invention is thus mainly to cancel the franking marks with cancellation marks of size that is variable but that is adapted to a critical situation. For example, when the mailpiece has its top edge placed between two consecutive belts and thus has, for example, a franking duty mark partially hidden by a belt, a cancellation mark that is smaller than the cancellation mark that can be printed normally over a franking duty mark that is fully visible between two consecutive belts is printed on the visible portion of the partially hidden franking duty mark. In addition, the cancellation mark can be printed in off-center manner over the franking mark. A cancellation mark of 40 millimeters (mm) by 40 mm in size can, for example, cover an area of the franking mark of as little as 4 mm by 4 mm.

Digital print heads exist that have multiple inkjets disposed in stages, e.g. the inkjet print heads distributed by Image. The nozzles of such a print head can thus be controlled in packets or stages of nozzles that are individually actuatable, and it is thus possible, for example, to print a pattern with the entire section of the print head, with three-quarters of the section of the print head, with one half of the section of the print head, or indeed with one quarter of the section of the print head.

It can be understood that the apparatuses disclosed by Documents EP-906792 and US2004/0218958 that do not determine whether the franking mark is off-center in a free zone do not make it possible for the cancellation mark to be printed partially.

Advantageously, such partial printing of the invention avoids spraying ink outside the mailpiece when said mailpiece is of small format, e.g. if its top edge is situated in the free zone defined between the top two belts. In addition to avoiding soiling the machine as a whole, and in particular the detector means, partial printing also avoids unnecessary ink consumption.

In a particular embodiment of the invention, the detector means comprise a camera suitable for taking a digital image of the face of the mailpiece, and data processor means suitable for identifying said franking marks in said digital image by contrast analysis.

In another embodiment of the invention, the detector means comprise a camera and data processor means suitable for detecting fluorescent or phosphorescent zones on the surface of a mailpiece.

In addition, the apparatus of the invention can have the following features:

- the detector means are arranged to detect a visible surface of the franking mark in a free zone, and the control means are arranged to select the inkjets of the print head facing the visible surface of the franking mark;
- the control means are arranged to activate only the uppermost inkjets if the mark is upwardly off-center, and only the lowermost inkjets if the mark is downwardly off-center; and
- the apparatus further comprises a pass sensor connected to the control means and arranged to compute the length of each mailpiece.

The invention also provides a sorting machine including cancelling apparatus as described hereinabove.

BRIEF DESCRIPTION OF THE DRAWINGS

The apparatus of the invention can be understood even more clearly on reading the following description of an embodiment shown in the drawing, in which.

DETAILED DESCRIPTION OF THE PREFERRED EMBODIMENTS

Figure 1:
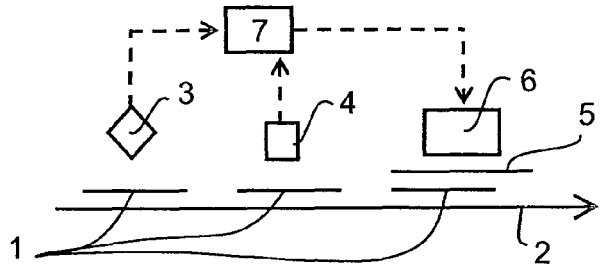
FIG. 1 is a block diagram of the elements of apparatus of the invention.

As shown in FIG. 1, mailpieces 1 are moved at high speed (at about 3.15 meters per second (m/s)) in series and on edge in a conveyor (represented by arrow 2) that runs firstly past a digital camera 3 for taking an image of a face of each mailpiece that bears a franking mark, secondly past a pass sensor 4 for detecting the instant at which the leading edge of each mailpiece goes past it, and thirdly past a belt conveyor segment 5 in which a print mechanism 6 is mounted that has a plurality of print heads serving to cancel/deface one or more franking marks present on each mailpiece under the control of a control unit 7 connected to the camera 3 and to the pass detector 4. This assembly can be an integral part of an automatic postal sorting machine that already has a camera for taking an image of each mailpiece with a view to decoding its address by Optical Character Recognition (OCR).

Figure 2:
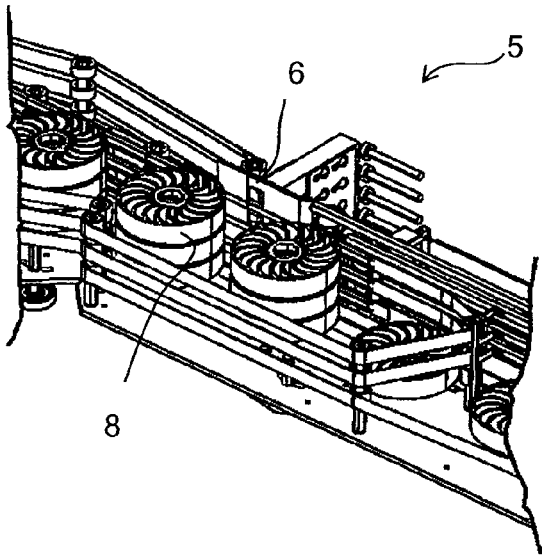
FIG. 2 is a highly diagrammatic perspective view of a portion of a belt conveyor of the invention for canceling franking duty marks.

FIG. 2 is a more detailed view of the belt conveyor segment 5 which, in this example, comprises three superposed belts (superposed in a direction perpendicular to the direction of movement of the mailpieces, and in the vertical direction in this example) that are of small width and that face respective elastically deformable wheels referred to as "low-pressure spoked wheels" 8. In this conveyor segment, the mailpieces are thus moved by being pinched between the belt and the wheels 8.

On an upstream portion of said conveyor segment (in the direction of movement of the mailpieces), a plurality of inkjet print heads of the print mechanism 6 are mutually superposed in such a manner as to be interposed between the belts 5. The downstream portion of this conveyor segment in the direction of movement of the mailpieces is a kind of delay line in which the mailpieces bearing the ink cancellation marks dry naturally. In this zone, an ink drier zone can be added (with drying being by ultraviolet (UV) radiation, forced-air, etc.).

Figure 3:
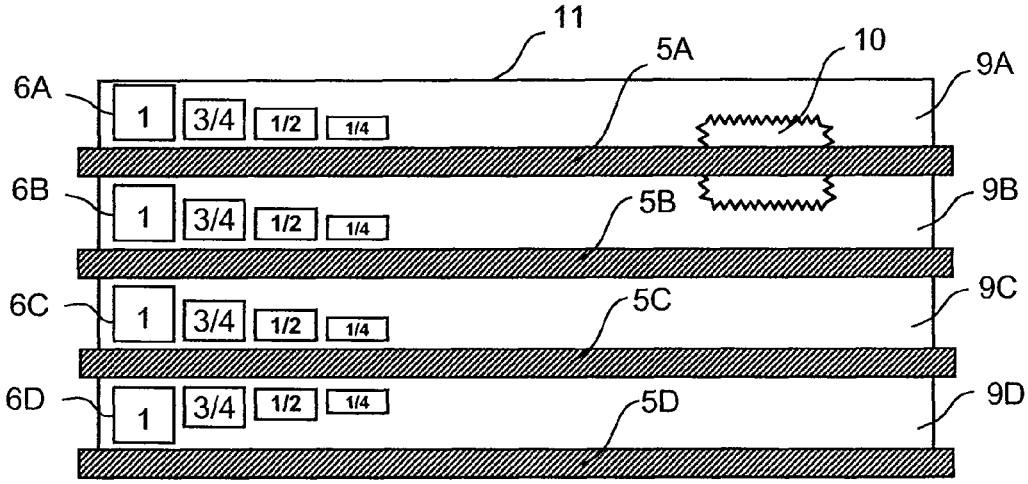
FIG. 3 shows printing of cancellation marks of various sizes.

FIG. 3 shows four superposed belts 5A-5D that define four free zones 9A-9D between them in the form of non-touching strips, the strips in each pair of strips being separated by a respective one of the belts. The print heads 6A-6D of the print mechanism are thus disposed facing respective ones of the free zones 9A-9D, and thus can print on the surface of the mailpiece through said free zones only.

In each free zone such as 9A, four rectangles that are of different sizes indicated by the values 1, ¾, ½, and ¼ are used to show four possibilities of printing a cancellation mark by a print head such as 6A.

In the invention, each print head is a digital print head having a plurality of inkjets in stages in a vertical direction that is perpendicular to the direction of movement of the mailpieces. The inkjets of a print head are thus controllable selectively, thereby making it possible to print only a portion of a cancellation mark, or a scaled-down version of that cancellation mark by actuating only 1 jet, 2 jets, or 3 jets of the print head.

FIG. 3 shows a franking mark (a stamp) indicated by reference 10 that is disposed on the surface of a mailpiece 11 in such a manner as to be off-center in the free zone 9A. This mark 10 is partially hidden by the belt 5A. In the invention, the print head 6A is controlled selectively so as to cancel the stamp 10 with a cancellation mark having the smallest size (¼ format) which, in this example, avoids unnecessary ink consumption.

As can be seen in FIG. 3, the control means 7 for controlling the print heads are arranged in a manner such that, in the two vertically outermost free zones, the reduction in the size of the cancellation mark goes from the top downwards for the uppermost free zone and from the bottom upwards for the lowermost free zone.

In accordance with the invention, the print heads are controlled selectively in this way, and the size of the cancellation mark is adapted to the position in space of the franking mark, by virtue of the fact that the processor unit 7 is arranged to detect the franking mark(s) such as 10 in the digital image of the surface of a mailpiece that is taken by the camera 3, and to locate each franking mark within the outline of the mailpiece and relative to the locations of the free zones so as to determine, for each detected franking mark, whether said mark is off-center in a free zone. If the franking mark is detected as being off-center, and as a function of the area of the franking mark that is visible in the free zone 9A-9D, the size of the cancellation mark is adjusted by a program to match the size of said visible area.

The franking marks in the image can be detected by searching the image for fluorescent zones when the surface of the mailpiece is subjected to blue light at the time at which the digital image is taken. Extracting the outline of the mailpiece can be performed in known manner by contrast analysis.

In the field of mail handling, postage marks are sometimes printed with a phosphorescent ink. Such marks are detected by subjecting the surface of the mailpiece to conventional white light. In which case, the invention makes provision for the franking marks in the image to be detected by searching the image for phosphorescent zones. Similarly, the outline of the mailpiece is extracted in known manner by contrast analysis.

The signal delivered by the sensor 4 enables the control unit 7 to calculate the length of each ordinary mailpiece, and, on this basis, when appropriate to repeat automatically the printing of a cancellation mark over a plurality of franking marks situated in the same free zone 9A-9D in the direction of movement of the mailpiece. It is understood that a plurality of print heads can be actuated at the same time if a plurality of franking marks are disposed in vertical superposition on the surface of the mailpiece without going beyond the ambit of the invention.

In accordance with the invention, the processor unit 7 is also arranged to detect, in the digital image of the surface of the mailpiece, the positions of the franking marks within the outline of the mailpiece relative to the direction of conveying 2. In which case, the processor unit 7 causes the print heads to operate with a certain amount of delay or with a certain amount of advance in response to a signal delivered by the pass sensor 4 for sensing when the leading edge of each mailpiece goes past. The cancellation mark is thus printed in dynamically adaptive manner and such that it is centered in the conveyor direction 2 on the franking mark.

The invention claimed is:

1. Apparatus designed to cancel at least one postage or franking mark on a surface of a mailpiece moving on edge in a belt conveyor, said apparatus comprising:

a conveyor portion with a plurality of superposed belts spaced to define a set of free zones therebetween in the form of non-touching superposed strips, the strips in each pair of adjacent strips being separated by a respective one of the belts;

a print mechanism comprising a plurality of superposed print heads facing respective ones of said free zones;

detector means positioned along the conveyor so as to detect at least one franking mark on the face of the mailpiece; and control means for controlling the print mechanism, on the basis of detecting said at least one franking mark on the surface of the mailpiece, in such a manner as to cause a print head to print a cancellation mark over the franking mark;

wherein each print head is suitable for operating selectively with a plurality of superposed inkjets, in that the detector means are also arranged to detect whether said franking mark is present in off-center manner in a free zone, and in that said control means are arranged so as to respond to detection of a franking mark that is off-center in said free zone by causing said print head disposed facing said free zone to operate while activating only some of its inkjets so as to print over the off-center franking mark one of a portion of said cancellation mark and a scaled down version of said cancellation mark.

2. Apparatus according to claim 1, in which said detector means comprise a camera suitable for taking a digital image of the face of the mailpiece, and data processor means suitable for identifying said franking marks in said digital image by contrast analysis.

3. Apparatus according to claim 1, in which said detector means comprise a camera and data processor means suitable for detecting fluorescent zones on the surface of a mailpiece.

4. Apparatus according to claim 1, in which said detector means comprise a camera and data processor means suitable for detecting phosphorescent zones on the surface of a mailpiece.

5. Apparatus according to claim 1, in which said detector means are further arranged to detect a visible surface of the franking mark in a free zone, and in which said control means are further arranged to select the inkjets of the print head facing the visible surface of the franking mark.

6. Apparatus according to claim 1, in which said control means are arranged to activate only the uppermost inkjets if the mark is upwardly off-center, and only the lowermost inkjets if the mark is downwardly off-center.

7. Apparatus according to claim 1, characterized in that it further comprises a pass sensor connected to the control means and arranged to compute the length of each mailpiece.

8. A postal sorting machine including apparatus according to claim 1.

* * * * *